US006395318B1

(12) United States Patent
Sumpmann et al.

(10) Patent No.: US 6,395,318 B1
(45) **Date of Patent: *May 28, 2002**

(54) DELAMINATING MEMBRANE LID FOR A CANISTER CONTAINING A PARTICULATE-TYPE PRODUCT

(75) Inventors: Patrick J. Sumpmann; Curtis J. Deering, both of Maple Grove, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/594,265

(22) Filed: Jun. 15, 2000

(51) Int. Cl.[7] ..... B65D 51/20; B65D 85/00

(52) U.S. Cl. ..... 426/115; 426/106; 426/122; 426/123; 220/258; 220/359.3; 229/125.03

(58) Field of Search ..... 426/106, 115, 426/122, 123; 220/258, 266, 268, 359.3, 259, 269; 229/123.1–123.3, 125.05, 125.35, 102, 125.08

(56) References Cited

U.S. PATENT DOCUMENTS

| | | | | |
|---|---|---|---|---|
| 2,398,405 A | * | 4/1946 | Brooks | 229/5.5 |
| 2,719,663 A | | 10/1955 | Meyer-Jagenberg | 229/120.15 |
| 2,889,976 A | | 6/1959 | Cantfort | 229/123.3 |
| 2,906,439 A | | 9/1959 | Santuci, Sr. | 222/183 |
| 2,971,686 A | | 2/1961 | Mühlhoff | 229/125.11 |
| 3,154,225 A | * | 10/1964 | Wadlinger et al. | 222/485 |
| 3,302,847 A | | 2/1967 | Hennessey | 229/102 |
| 3,768,719 A | | 10/1973 | Johnson | 229/14 B |
| 4,267,937 A | | 5/1981 | Piltz et al. | 220/267 |
| 4,401,229 A | * | 8/1983 | Bell et al. | 220/259 |
| 4,453,666 A | | 6/1984 | Gordon | 229/43 |
| 4,491,252 A | | 1/1985 | Schmidt et al. | 222/531 |
| 4,583,679 A | | 4/1986 | Johnson | 229/43 |
| 4,673,126 A | | 6/1987 | Hambleton | 229/43 |
| 4,706,875 A | | 11/1987 | Blackman | 206/626 |
| 4,768,703 A | | 9/1988 | Sosler et al. | 229/123.1 |
| 4,819,829 A | | 4/1989 | Rosten et al. | 220/346 |
| 4,836,380 A | * | 6/1989 | Walter et al. | 206/561 |
| 5,078,273 A | | 1/1992 | Kuchenbecker | 229/207 |
| 5,566,529 A | | 10/1996 | Sireix | 53/412 |
| 5,727,819 A | | 3/1998 | Grosskopf et al. | 238/81 |

FOREIGN PATENT DOCUMENTS

| | | |
|---|---|---|
| DE | 196 35 190 A1 | 3/1998 |
| WO | WO 99/30974 | 6/1999 |

OTHER PUBLICATIONS

Three–Dimensional Pioneer® Baking Mix packaging as shown in five photographs depicting different views, Copyright 1996 Pioneer Flour Mills.

* cited by examiner

*Primary Examiner*—Milton I. Cano
*Assistant Examiner*—Robert A Madsen
(74) *Attorney, Agent, or Firm*—John A. O'Toole; Douglas J. Taylor; Timothy A. Czaja

(57) ABSTRACT

A canister for containing a particulate-type product. The canister includes opposing face panels, opposing side panels, a bottom closure, a top closure and a seal membrane. The opposing side panels together with the opposing face panels define an upper opening and a lower opening. The bottom closure is connected to the opposing face panels so as to encompass the lower opening. The opposing face panels, the opposing side panels and the bottom closure combine to define an internal storage region. The seal membrane is secured to the top closure, and then the top closure/seal membrane combination is connected to the opposing face panels so as to encompass the upper opening. The seal membrane insures the freshness of the particulate-type product. The top closure includes a movable lid member that provides selective access to the internal storage region. Upon initial opening of the lid member, first portion of the seal membrane delaminates from a remaining air-tight seal portion of the seal membrane. The remaining seal portion includes perforations that allow a consumer to remove this portion to gain access to the particulate-type product. In one preferred embodiment, the canister is configured to store a food product, for example a ready-to-eat cereal.

65 Claims, 8 Drawing Sheets

DELAMINATING MEMBRANE LID FOR A CANISTER CONTAINING A PARTICULATE-TYPE PRODUCT

CROSS REFERENCE TO RELATED APPLICATIONS

This patent application is related to U.S. patent application Ser. No. 09/328,917, entitled "Canister For A Particulate-Type Product" filed on Jun. 9, 1999, now abandoned, assigned to the same assignee, and incorporated herein by reference thereto. In addition, this patent application is related to U.S. patent application Ser. No. 09/346,443, entitled "Perforated Air-Tight Seal Membrane For A Canister Containing A Particulate-Type Product", filed on Jul. 1, 1999, now U.S. Pat. No. 6,355,286; to U.S. patent application Ser. No. 09/346,189, entitled "Double Cut Seal Membrane For A Canister Containing A Particulate-Type Product",filed on Jul. 1, 1999; to U.S. patent application Ser. No. 09/346,441, entitled "Canister With Adhered Paper Layers For A Particulate-Type Product", filed on Jul. 1, 1999, now U.S. Pat. No. 6,338,864; and to U.S. patent application Ser. No. 09/346,440, entitled "Canister With Venting Holes For Containing A Particulate-Type Product", filed on Jul. 1, 1999, now U.S. Pat. No. 6,261,615 assigned to the same assignee, and incorporated herein by reference thereto. Further, this patent application is related to U.S. patent application Ser. No. 09/448,044, entitled "Canister With Detachable Premium For Containing A Particulate-Type Product", filed on Nov. 23, 1999, now U.S. Pat. No. 6,267,243, assigned to the same assignee, and incorporated herein by reference thereto. Moreover, this patent application is related to U.S. patent application Ser. No. 09/528,287, entitled "Canister With Visible Three-Dimensional Premium For Containing A Particulate-Type Product", filed on Mar. 17, 2000, assigned to the same assignee, and incorporated herein by reference thereto. Lastly, this patent application is related to U.S. patent application Ser. No. 09/492,405, entitled "Canister With Clear Window For Viewing A Particulate-Type Product Contained Within The Canister", filed on Jan. 27, 2000, assigned to the same assignee, and incorporated herein by reference thereto.

BACKGROUND OF THE INVENTION

The present invention relates to canisters for containing particulate-type products. In particular, the present invention is an air-tight membrane that seals an opening within the canister to ensure freshness of a particulate-type product, such as ready to eat cereal, contained within the canister. The air-tight seal membrane includes a first portion that delaminates from a remaining air-tight sealing portion upon opening of a lid member of the canister. The remaining air-tight sealing portion includes perforations that allow a consumer to easily open the remaining air-tight sealing portion to gain access to the particulate-type product.

An extremely popular form of packaging for dry, particulate-type products sold to consumers is a paper carton. A wide variety of different products are packaged in this form, ranging from consumable items such as cereals and baking goods to non-consumable items such as laundry detergents and de-icing salt pellets. Paper cartons present a number of advantages for manufacturers, retailers and ultimate consumers. For example, paper cartons are relatively inexpensive to manufacture and provide a number of flat surfaces onto which product or promotional information can be displayed. Further, paper cartons normally assume a rectangular, parallel-piped shape and are therefore readily stackable. Thus, a retailer can maximize shelf space while fully displaying the product. Obviously, consumers likewise find the stackability characteristic desirable for home storage. Finally, paper cartons are typically sized in accordance with consumer preferences such that a desired amount or volume of product is provided with each individual carton.

Certain types of products are amenable to storage within a paper carton alone. Generally speaking, however, a paper carton cannot, in and of itself, prevent degradation of the contained product to adequately maintain product integrity. For example, a paper carton likely will not prevent aroma, flavor, moisture, grease, oil, contaminants, small insects, etc. from passing through to the contained product. Thus, packaging for virtually all particulate-type products requires an additional container or liner disposed within the paper carton. This is especially true for consumable/food products. A widely accepted technique for maintaining product integrity is to place the product into an inner container or bag, that in turn is stored in the carton (commonly referred to as a "bag in a box"). The bag is typically made of a plastic or glassine material and is sealed about the product. In this sealed form, the bag maintains product freshness and protection against insect infestation, whereas the outer paper carton provides packaging strength and display. Alternatively, a double packaging machine (DPM) technique may be employed to form a plastic or glassine liner within a paper carton on the inner surface thereof.

From a manufacturer's standpoint, this box and inner liner packaging approach satisfies a number of important criteria including low cost, stackability, and large, flat surfaces for displaying product and promotional information. Unfortunately, however, paper cartons having plastic or glassine liners adhered to their inner surfaces may exhibit potential drawbacks. These possible disadvantages are perhaps best illustrated by reference once again to a ready-to-eat cereal product.

To manufacture a ready-to-eat cereal product paper carton having an adhered plastic or glassine liner, first the plastic or glassine liner is adhesively attached to a generally rectangular paper board substrate. Next, the paper board substrate with the liner adhered thereto is formed (such as by wrapping this structure about a mandrel) into a tubular main portion having opposing face panels and opposing side panels that define the body of the paper carton. This tubular main body portion includes upper and lower openings. Next, a seal membrane of plastic material is applied to the upper opening of the tubular main body portion to form an air-tight seal at this location. A paper board top panel or closure is then connected to the tubular main body portion over the seal membrane so as to encompass the upper opening. Next, the ready-to-eat cereal product is placed within the tubular main body portion through the lower opening. Finally, a paper board bottom panel or closure is connected to the tubular main body portion so as to encompass the lower opening.

One potential drawback of the paper carton having an adhered plastic or glassine liner packaging approach is the difficulty of inserting and properly sealing the upper opening of the tubular main body portion. From an automated manufacturing standpoint, it is a fairly complex two step procedure to first apply the plastic seal membrane to the upper opening in the tubular main body portion and then to apply the paper board closure panel over the plastic seal membrane. It is vital that this two step process be performed properly since the plastic seal membrane and the paper board closure panel function as an air tight seal at the upper opening in the tubular main body portion. Absent an air tight seal, the freshness and integrity of the ready-to-eat cereal product (i.e., particulate-type product) may be compromised, since without the air tight seal, contaminants, flavors, aromas, moisture, oil, grease small insects, etc. may pass through to the contained product.

Consumers continue to express a high demand for particulate-type products sold in paper cartons with plastic liners. However, manufacturing problems associated with the production of standard packaging, and in particular box with inner liner packages, may diminish purchasing enthusiasm. Therefore, a need exists for a particulate-type product canister that can be easily manufactured to provide an air tight seal to insure the freshness and integrity of the particulate-type product contained within canister. In particular, there is a need for a canister having a tubular main body portion whose upper opening can be consistently, readily and easily sealed with a plastic seal membrane and paper board closure panel to form an air tight seal at the upper opening of the tubular main body portion to maintain the freshness and the integrity of the particulate-type product, by preventing such things as contaminants, flavor, aroma, moisture, oil, grease, small insects, etc. from passing through to the contained product. Moreover, there is a need for a canister whose upper opening is sealed by way of a seal membrane and closure panel that can be readily opened to allow a consumer to easily gain access to the particulate-type product.

SUMMARY OF THE INVENTION

One aspect of the present invention provides a canister for storing a particulate-type product. The canister includes a main body portion, a bottom closure, a top closure and a seal membrane. The main body portion has an inner surface and an outer surface. The main body portion defines an upper opening and a lower opening. The bottom closure is connected to the main body portion so as to encompass the lower opening. The main body portion and the bottom closure combine to define an internal storage region. The top closure has an upper surface and a lower surface, and is connected to the main body portion so as to encompass the upper opening. With this in mind, the top closure includes an openable lid member having an upper surface and a lower surface. The lid member is configured to provide selective access to particulate-type product disposed within the internal storage region. Finally, the seal membrane forms a seal at the upper opening configured to maintain integrity of particulate-type product disposed within the internal storage region. The seal membrane includes a first substrate and a second substrate. Each of the first and second substrates includes a first surface and a second surface. The second surface of the first substrate is secured to the inner surface of the main body portion and positioned immediately adjacent particulate-type product disposed within the internal storage region. The first surface of the second substrate is non-removably secured to at least a portion of the lower surface of the lid member. The second surface of the second substrate is removably secured to the first surface of the first substrate, such that upon initial opening of the lid member, the second substrate delaminates from the first substrate at an interface, defined between the second surface of the second substrate and the first surface of the first substrate, and remains affixed to the lower surface of the lid member. In one preferred embodiment, the canister is configured to maintain a food product such as ready-to-eat cereal.

Another aspect of the present invention relates to a packaged good article comprising a canister and a particulate-type product. The canister includes a main body portion, a bottom closure, a top closure and a seal membrane. The main body portion has an inner surface and an outer surface. The main body portion defines an upper opening and a lower opening. The bottom closure is connected to the main body portion so as to encompass the lower opening. The main body portion and the bottom closure combine to define an internal storage region. The top closure has an upper surface and a lower surface, and is connected to the main body portion so as to encompass the upper opening. With this in mind, the top closure includes an openable lid member having an upper surface and a lower surface. The lid member is configured to provide selective access to particulate-type product disposed within the internal storage region. Finally, the seal membrane forms a seal at the upper opening configured to maintain integrity of particulate-type product disposed within the internal storage region. The particulate-type product is disposed and contained within the internal storage region. The seal membrane includes a first substrate and a second substrate. Each of the first and second substrates includes a first surface and a second surface. The second surface of the first substrate is secured to the inner surface of the main body portion and positioned immediately adjacent particulate-type product disposed within the internal storage region. The first surface of the second substrate is non-removably secured to at least a portion of the lower surface of the lid member. The second surface of the second substrate is removably secured to the first surface of the first substrate, such that upon initial opening of the lid member, the second substrate delaminates from the first substrate at an interface, defined between the second surface of the second substrate and the first surface of the first substrate, and remains affixed to the lower surface of the lid member. In one preferred embodiment, the particulate-type product is a dry, ready-to-eat cereal.

Yet another aspect of the present invention relates to a method of manufacturing a canister for containing a particulate-type product. The method includes providing a top closure having an upper surface and a lower surface. The closure has an openable lid member having an upper surface and a lower surface. A seal membrane is secured to the lower surface of the top closure and lid member to define a top closure/seal membrane. A tubular main body portion having an inner surface and an outer surface is then provided. The tubular main body portion defines an upper opening and a lower opening. Next, the upper opening of the tubular body is encompassed with the top closure/seal membrane. Similarly, the lower opening of the tubular body is encompassed with a bottom closure. The resulting canister forms an internal storage region for containing a particulate-type product. In one preferred embodiment, the resulting canister is configured to maintain a dry, ready-to-eat cereal food product.

During use, a user opens the canister by opening the lid member of the top closure. Upon opening of the lid member the second substrate delaminates from the first substrate. Perforations allow the consumer to readily remove an access portion of the second substrate thereby exposing the particulate-type product within the internal storage region of the canister. With the lid member of the top closure opened, the particulate-type product can be distributed from the canister. Following distribution of a desired quantity of product, the lid member of the top closure is returned to a closed position, effectively resealing the canister. By securing the seal membrane to the lower surface of the top closure and lid member prior to attaching the top closure/seal membrane to the upper opening of the tubular main body portion of the canister, allows this upper opening to be consistently, readily and easily sealed thereby forming an air tight seal at this upper opening capable of maintaining the freshness and the integrity of the particulate-type product, by preventing such things as contaminants, flavor aroma, moisture, oil, grease, small insects, etc. from passing through to the contained product.

DETAILED DESCRIPTION OF THE PREFERRED EMBODIMENTS

Figure 1:
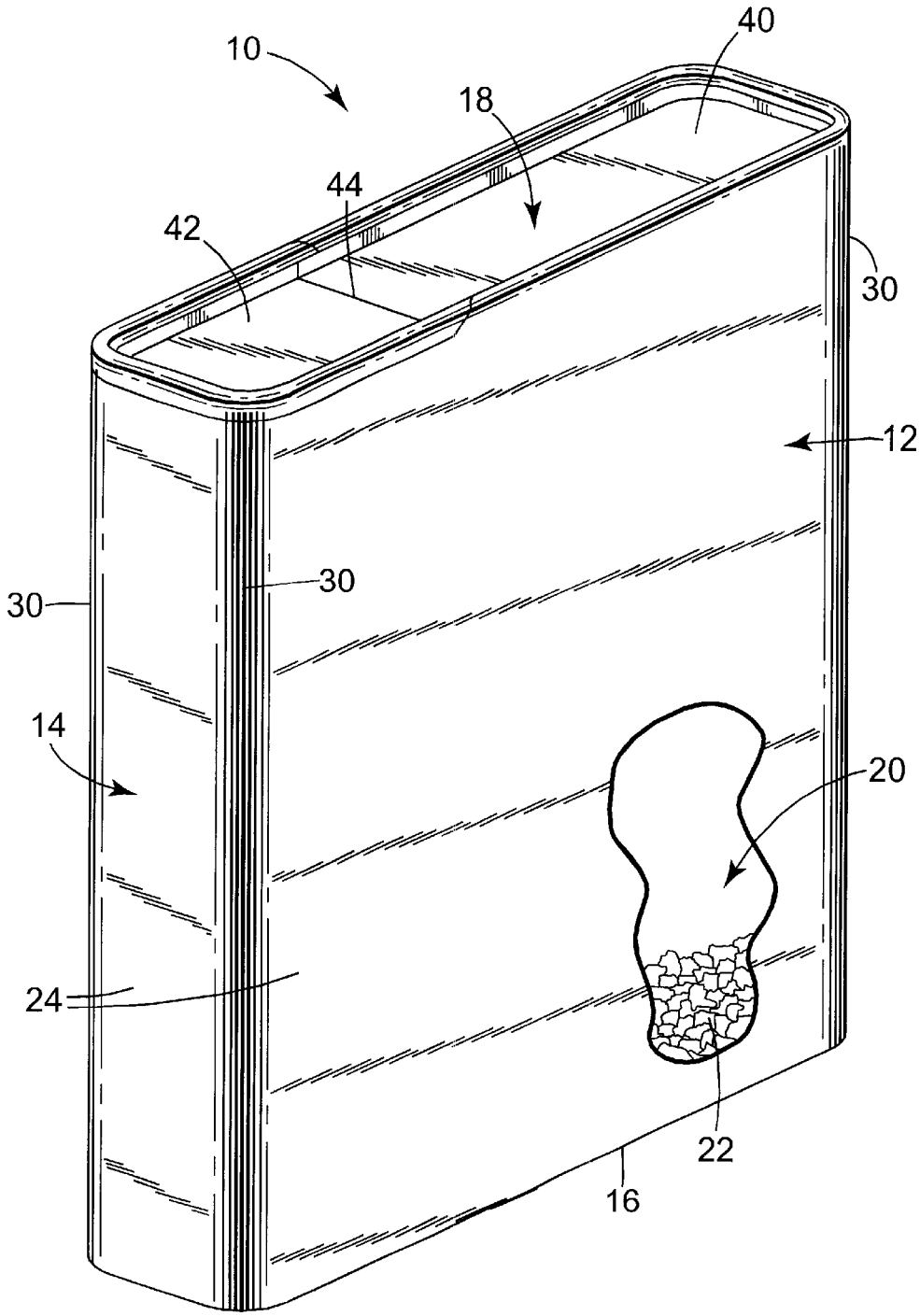
FIG. 1 is a perspective view of a canister in accordance with the present invention with a portion cut away.

A canister 10 in accordance with the present invention is shown generally in FIGS. 1–4. The canister 10 includes opposing face panels 12 (one of which is shown in FIG. 1), opposing side panels 14 (one of which is shown in FIG. 1), a bottom closure, such as bottom panel 16 (shown partially in FIG. 1) and a top closure, such as top panel 18. The opposing face and side panels 12, 14 define a main body portion of the canister 10. As seen best in FIG. 4, each of the opposing face panels 12 and each of the opposing side panels 14 includes an inner surface 23 and an outer surface 24. As described in greater detail below, the opposing face panels 12 and the opposing side panels 14 are preferably integrally formed. In this regard, the combination of the opposing face panels 12 and the opposing side panels 14 defines an upper opening 60 (shown partially in FIG. 11B) and a lower opening 62 (shown partially in FIG. 11B). The separate bottom panel 16 is connected to the opposing face panels 12 and the opposing side panels 14 at a lower portion thereof. Similarly, the separate top panel 18 is connected to the opposing face panels 12 and the opposing side panels 14 at an upper portion thereof. This configuration provides for an internal storage region 20 (shown partially in FIG. 1) within which a particulate-type product 22 is disposed. Alternatively, the opposing face panels 12, the opposing side panels 14 and the bottom panel 16 can be integrally formed as a single unit. The separate top panel 18 would then be connected to the opposing face and side panels 12, 14 at the upper portions thereof to define the internal storage region 20 within which a particulate-type product 22 is disposed. As a further alternative, the bottom panel 16 can be formed from the opposing face and side panels 12, 14 themselves as in current conventional "bag in a box" packaging. In this further alternative, the lower portions of the opposing face and side panels 12, 14 would be folded to overlap and define the bottom panel 16 of the canister 10. Notably, directional terminology such as "bottom," "top," "upper" and "lower" are used for purposes of illustration and with reference to a desired upright orientation of the canister 10 as shown in FIG. 1. However, the canister 10 can be positioned in other orientations such that the directional terminology is in no way limiting.

Each of the panels 12–18 is formed from a paper and plastic material. For example, as seen best in FIG. 4, in one preferred embodiment, a layer of plastic 19 is adhered or laminated to a layer of paper or paperboard 21 to form each of the panels 12–18. Multiple layers of plastic and/or paper can also be employed. Alternatively, a plastic material or resin can be intertwined with the fibers of a paperboard. As a further alternative, the panels 12–18 could be formed entirely of plastic, such as high density polyethylene (HDPE). Regardless of exact construction, the resulting panels 12–18 are preferably formed to allow printing or similar displays on an outer surface 24 (shown generally in FIG. 1) thereof. Thus, the panels 12–18 are preferably highly similar in appearance to currently available box with an inner liner cartons. Further, the combination paper and plastic material is preferably recyclable and provides a functional barrier to at least one of flavor, aroma, moisture, oil, grease, other contaminants, insects, etc. The selected plastic must be suitable for contact with the particulate-type product 22. For example, where the particulate-type product 22 is a food product, the selected plastic material must be approved for food contact, as is well known in the art. Thus, for example, the plastic material can be polyethylene (low density or high density), chlorinated plastic, ethylene vinyl acetate, polyester, nylon, polypropylene, etc. Even further, the plastic can be various co-polymers, blends or a combination of plastic materials.

By forming the panels 12–18 from a combination of paper and plastic material, the resulting canister 10 is semi-rigid (due to the paper board material), and is able to serve as a functional barrier (via the plastic material) to at least one of aroma, flavor, insects, moisture, oil, grease or other contaminants. Thus, the canister 10 can be used to maintain a wide variety of particulate-type products. For example, the particulate-type product 22 can be a food product, and in particular a dry food product. One specific category of available food products is cereal-based products (e.g., formed from wheat, oats, rice, etc). These include ready-to-eat cereals such as puffs, flakes, shreds, and combinations thereof. Further, the ready-to-eat cereal product can include other ingredients such as dried fruits, nuts, dried marshmallows, sugar coatings etc. Alternatively, other particulate-type dry food products can be maintained by the canister 10 such as, for example, popcorn (popped or unpopped), dried pasta (e.g., spaghetti noodles), rice, beans, pretzels, potato chips, sugar, dried milk, flour, etc. Even further, other consumable items such as birdseed can be used as the particulate-type product 22. Yet even further, non-consumable particulate-type products can be stored including fertilizer pellets, dry laundry detergent, dry dishwashing detergent, plant or vegetable seeds, de-icing salt pellets, etc. Regardless of the exact product selected for the particulate-type product 22, the combination paper and plastic material comprising the panels 12–18 facilitates the canister 10 maintaining integrity of the product 22 independent of any additional liners or bags. That is to say, the panels 12–18 provide a barrier to at least one of moisture, flavor, aroma, oil, grease, insects and other contaminants, etc. thereby protecting the product 22 and maintaining freshness.

With the above-described paper and plastic composition of the panels 12–18 in mind, the opposing face panels 12 and the opposing side panels 14 are preferably integrally formed. Alternatively, the opposing face panels 12 and the opposing side panels 14 can be independently formed and subsequently secured to one another. Regardless, the opposing face panels 12 and the opposing side panels 14 are preferably sized to maintain a preferred volume of the particulate-type product 22. To this end, a resulting shape of a combination of the opposing face panels 12 and the opposing side panels 14 preferably corresponds with a shape and size of "standard" packaging normally associated with the product 22. Thus, where the product 22 is a ready-to-eat cereal, the shape and size of the opposing face panels 12 and the opposing side panels 14 is preferably highly similar to the size and shape of a carton within which the cereal is normally provided. By employing a similar package size, consumers will be familiar with and readily identify contents of the canister 10. Thus, in one preferred embodiment, the opposing face panels 12 each have a height of approximately 12 inches and width of approximately 8 inches, whereas the opposing side panels 14 each have a width of approximately 2¾ inches and a height of approximately 12 inches. Importantly, a wide variety of other sizes, either greater or smaller, and shapes are equally acceptable.

Regardless of the exact size and shape, the opposing face panels 12 and the opposing side panels 14 combine to form a plurality of longitudinally extending corners 30. In one preferred embodiment, four of the longitudinally extending corners 30 are provided (three of which are shown in FIG. 1). As illustrated in FIG. 1, each of the longitudinally extending corners 30 is preferably rounded. Each of the corners 30 is arcuate in transverse cross-section. By forming the corners 30 in this manner, the canister 10 facilitates easy handling by a user (not shown). Unlike a "standard" paper carton design in which the corners are formed as sharp, ninety-degree angles, the preferred arcuate configuration of the corners 30 comfortably fits within a user's hand. This preferred feature allows a user with limited hand dexterity (such as a child or elderly individual) to easily grasp and maneuver the canister 10. While all of the corners 30 are depicted in FIG. 1 as being rounded, as few as one of the corners 30 can be so-formed yet still provide a "easy-to-handle" characteristic. Even further, one or both of the opposing side panels 14 can be rounded or bowed to facilitate easy handling. Alternatively, the corners 30 could be squared off as in more traditional box type packaging.

Figure 2:
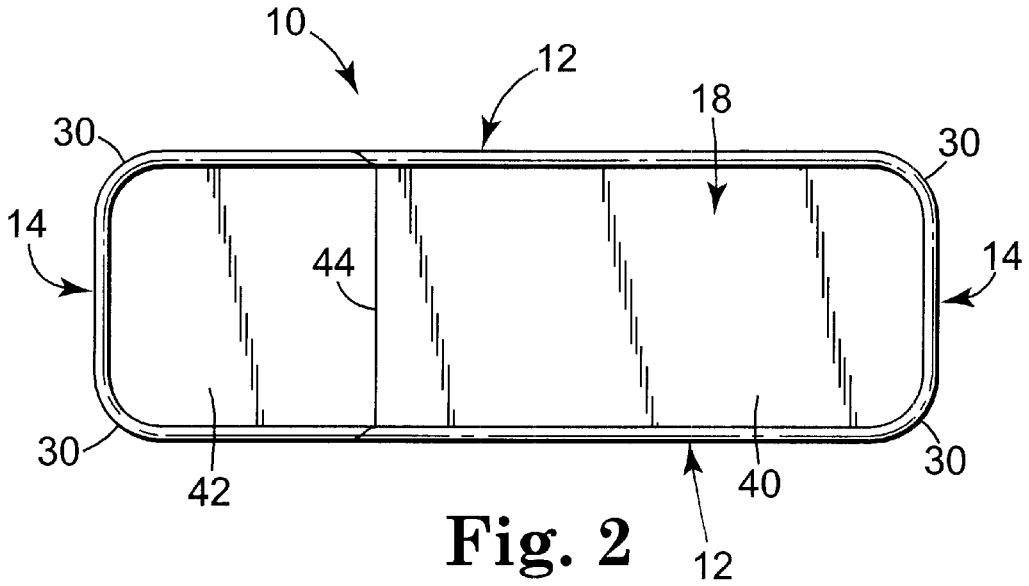
FIG. 2 is a top view of the canister of FIG. 1.

The bottom panel 16 is sized in accordance with a cross-sectional shape of the combination of the opposing face panels 12 and the opposing side panels 14. Thus, the bottom panel 16 is preferably curvilinear, having relatively straight sides and arcuate or curved corners. The top panel 18 is similarly sized in accordance with a cross-sectional shape of the opposing face panels 12 in combination with the opposing side panels 14. As a result, the top panel 18 preferably has relatively straight sides and arcuate or curved corners. One preferred embodiment of the top panel 18 is shown in FIG. 2. Each of the top and bottom panels 16, 18 are primarily formed from a paper or paperboard material. Multiple layers of plastic and/or paper can also be employed. Alternatively, a plastic material or resin can be intertwined with the fibers of a paperboard. As a further alternative, the top and bottom panels 16, 18 could be formed entirely of plastic, such as high density polyethylene (HDPE).

Thus, for example, the plastic material can be polyethylene (low density or high density), chlorinated plastic, ethylene vinyl acetate, polyester, nylon, polypropylene, etc. Even further, the plastic can be various co-polymers, blends or a combination of plastic materials.

Figure 3:
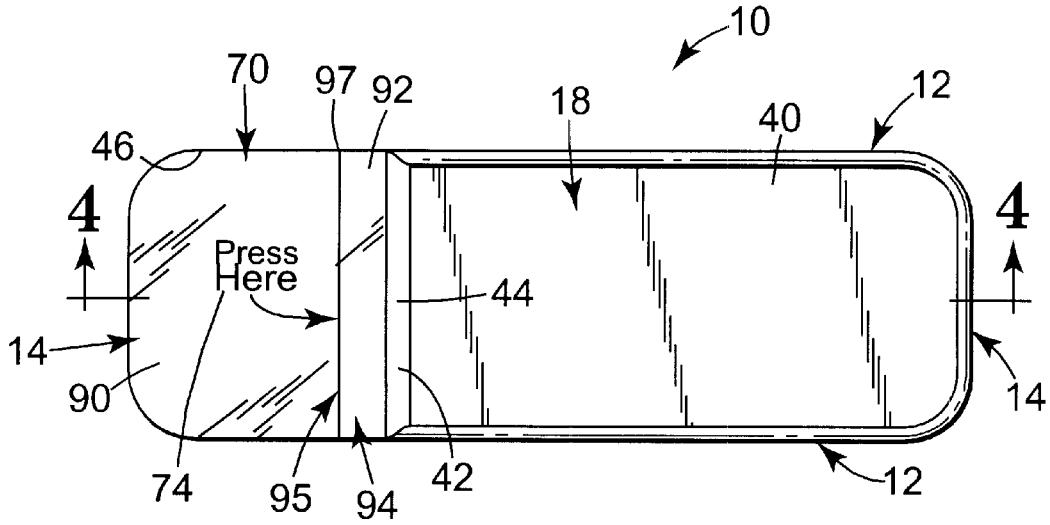
FIG. 3 is a top view of the canister of FIG. 1 with a movable lid portion opened for clarity illustrating an air tight seal membrane of the canister in accordance with the present invention.
Figure 4:
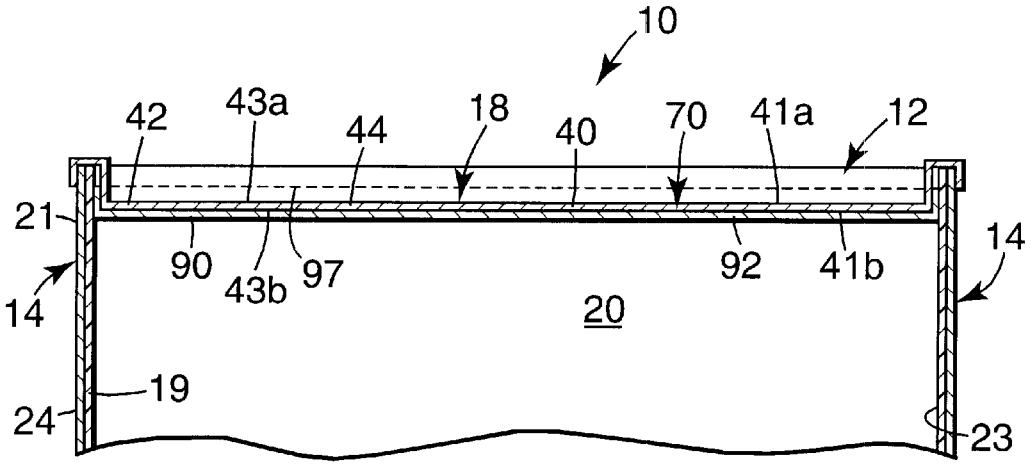
FIG. 4 is a partial sectional view taken along line 4—4 in FIG. 3 but with the lid portion in a closed state.

As seen best in FIG. 4, the top panel 18 is depicted as including a body portion 40, having upper and lower surfaces 41*a,* 41*b,* respectively, and a lid member 42, having upper and lower surfaces 43*a,* 43*b,* respectively. As a point of reference, the lid member 42 is shown in FIGS. 2 and 4 in a closed position whereby the lid 42 is substantially contiguous with the body portion 40. In general terms, the lid 42 is preferably configured to be movable relative to the body portion 40. In FIG. 3, the lid member 42 is shown in an opened position at a 90° angle with respect to the body portion 40. Thus, in one preferred embodiment, the lid 42 is pivotable relative to the body portion 40 along a pivot point 44. This pivoting relationship can be created by forming a bend into the top panel 18. Alternatively, an additional hinge body can be provided. Conversely, the lid 42 can be configured so as to be entirely removable from the body portion 40, such as along a perforation line. In this regard, the body portion 40 can be configured to include a ridge to which the lid 42 snap fits. Regardless of exact construction, however, the top panel 18 is preferably configured such that the lid 42 is maintained in a closed position (FIG. 2) by frictional engagement with the body portion 40.

Figure 5:
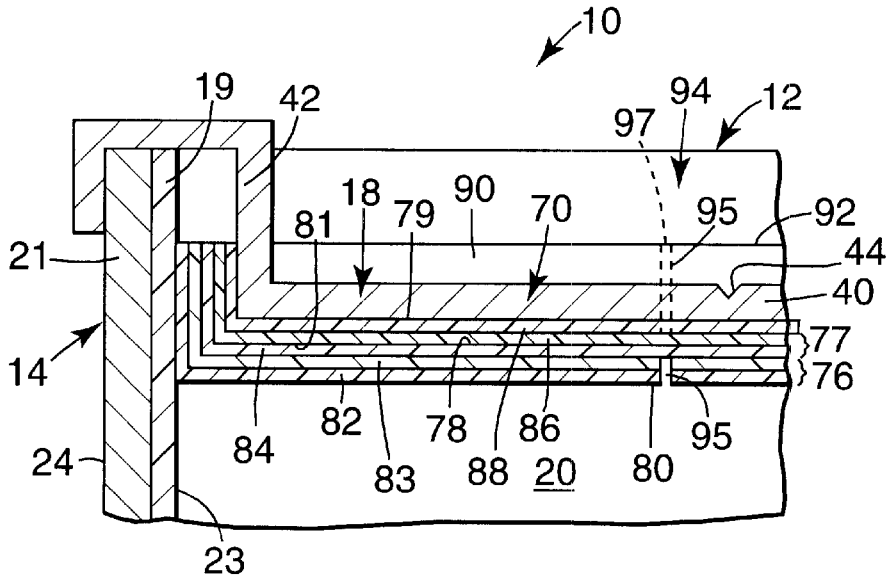
FIG. 5 is a greatly enlarged, partial sectional view similar to FIG. 4 showing details of the air tight seal membrane in accordance with the present invention.

As seen best in FIGS. 3–5, in accordance with a preferred embodiment of the present invention, the canister 10 further includes a delaminating air tight seal membrane 70 to enhance product freshness and to provide an indication of product tampering. For ease of illustration, the canister 10 is shown in FIG. 3 with the lid member 42 opened. The seal membrane 70 is beneath the top panel 18. The seal membrane 70 is affixed to the inner surfaces 23 of the opposing face and side panels 12 and 14 so as to extend across the entire upper opening 60 of the canister 10. The seal membrane 70 forms a seal at the upper opening 60 that acts to maintain the integrity and freshness of the particulate-type product 22 within the internal storage region 20 of the canister 10.

Figure 6:
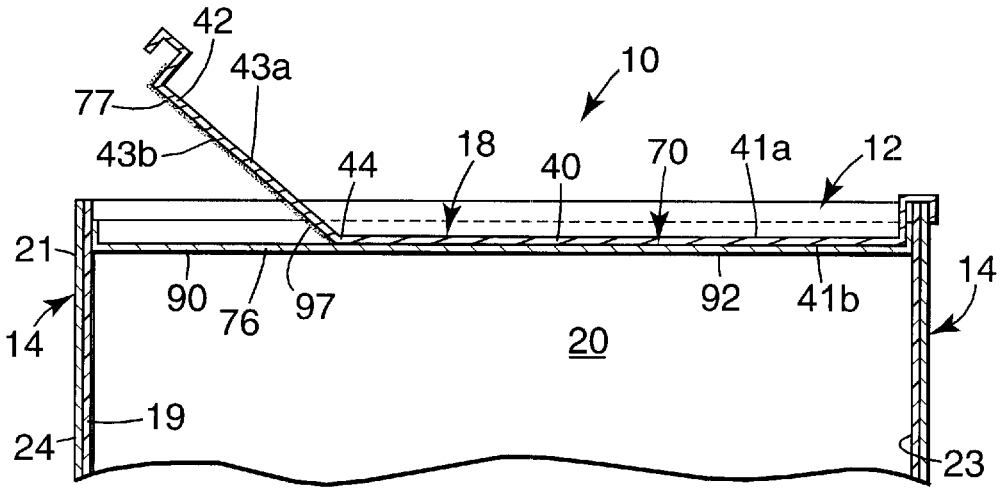
FIG. 6 is a partial sectional view similar to FIG. 4 with the lid portion of the top panel of the canister in an opened state.
Figure 7:
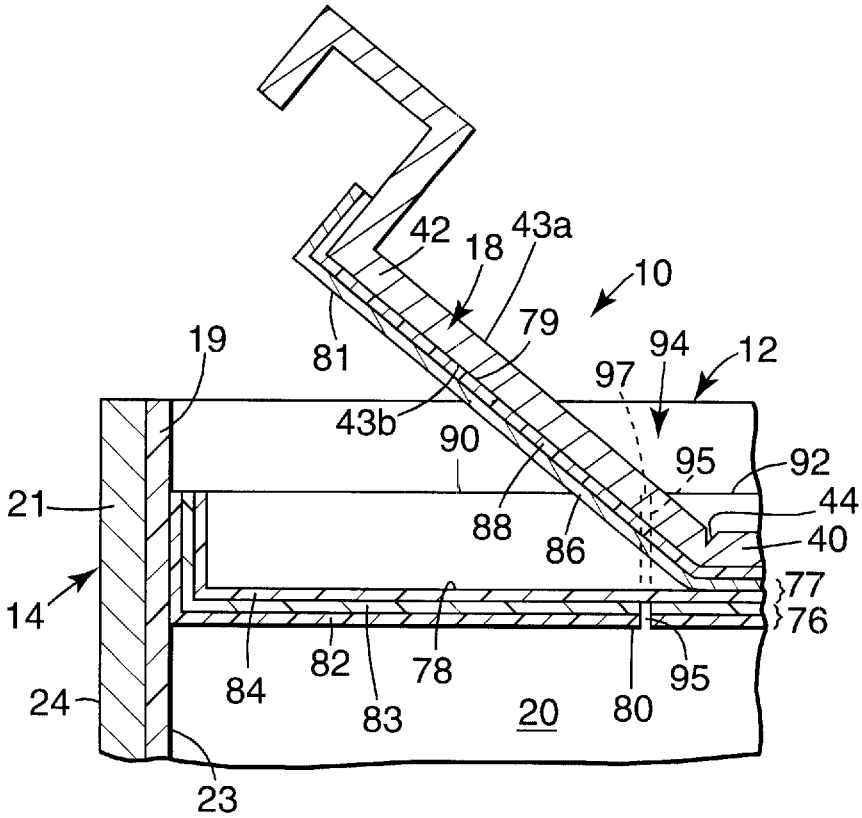
FIG. 7 is a greatly enlarged, partial sectional view similar to FIG. 6 showing details of air tight seal membrane in accordance with the present invention.

As seen best in FIG. 5, the seal membrane 70 preferably includes a first substrate 76 and a second substrate 77. The first substrate 76 has an upper surface 78 and a lower surface 80. The lower surface 80 of the first substrate 76 is immediately adjacent the particulate-type product 22 within the internal storage region 20. The second substrate 77 has an upper surface 79 and a lower surface 81. The upper surface 79 of the second substrate 77 constitutes an outer surface of the seal membrane 70 and is non-removably secured to at least a portion of the lower surface 43*b* of the lid member 42. In one preferred embodiment, the upper surface 79 of the second substrate 77 is non-removably secured to substantially all of the lower surfaces 41*b,* 43*b* of the body portion 40 and lid member 42 of the top panel 18. The first substrate 76 includes a bottom ply 82, an intermediate ply 83 and a top ply 84. A lower surface of the bottom ply 82 defines the lower surface 80 of the first substrate 76. An upper surface of the top ply 84 defines the upper surface 78 of the first substrate 76. The second substrate 77 includes a lower ply 86 and an upper ply 88. An upper surface of the upper ply 88 defines the upper surface 79 of the second substrate 77. A lower surface of the lower ply 86 defines the lower surface 81 of the second substrate 77. The second substrate 77 is affixed to the first substrate 76 by way of the lower ply 86 of the second substrate 77. As seen in FIGS. 6 and 7, this lower surface 81 of the lower ply 86 of the second substrate 77 is removably secured to the upper surface 78 of the top ply 84 of the first substrate 76, such that upon initial opening of the lid member 42, the second substrate 77 delaminates from the first substrate 76 at the interface between the lower surface 81 of the lower ply 86 of the second substrate 77 and the upper surface 78 of the top ply 84 of the first substrate 76, and remains affixed to the lower surface 43*b* of the lid member 42. Although, the seal membrane 70 is illustrated as being comprised of five plies, it is to be understood that the seal membrane can comprise more or less layers as technology requirements change.

In one preferred embodiment, the lower ply 86 can be a suitable adhesive that can adhere to the upper surface 78 of the first substrate 76 (i.e., the top ply 84), and the upper ply 88 can be a suitable adhesive that can adhere to the lower surfaces 41*b*, 43*b* of the body portion 40 and lid member 42 of the top panel 18. These adhesives can be glues, resins, epoxies, hot melts, polymers and/or blended compositions of these materials. The adhesive defining the upper ply 88 is different than the adhesive defining the lower ply 86 in that the adhesive of the upper ply 88 has a bond strength that is greater than the bond strength of the adhesive of the lower ply 86.

The first substrate 76, and in particular, the top ply 84 of the first substrate 76, provides a functional barrier to at least one of flavor, aroma, moisture, oil, grease, insects, other contaminants, etc. This functional barrier maintains the integrity and freshness of the particulate-type product 22 contained within the internal storage region 20 of the canister 10 by preventing the passage of these contaminants through to the product 22.

The bottom ply 82 of the first substrate 76 serves to attach the seal membrane 70 to the inner surfaces 23 of the opposing face and side panels 12 and 14. The intermediate ply 83 permits separation of the seal membrane 70 (i.e., the intermediate and top plies 83 and 84 and a portion of the bottom ply 82 of the first substrate 76) from the inner surfaces 23 of the panels 12, 14, to facilitate selective removal of at least a portion of the seal membrane 70 from the upper opening 60 to provide selective access to the internal storage region 20 and the particulate-type product 22 contained therein. Although only the top ply 84 of the seal membrane 70 is illustrated and described as a functional barrier, it is to be understood that more or all of the plies 82, 83, 84, 86, 88 could function as barrier plies.

In one preferred embodiment, the intermediate ply 83 can be a suitable adhesive that can adhere to the top and bottom plies 84, 82 of the first substrate 76, and the bottom ply 82 of the first substrate 76 can be a suitable adhesive that can adhere to the inner surfaces 23 of the opposing face and side panels 12 and 14. These adhesives can be glues, resins, epoxies, hot melts, polymers and/or blended compositions of these materials. The adhesive defining the bottom ply 82 is different than the adhesive defining the intermediate ply 83 in that the adhesive of the bottom ply 82 has a bond strength that is greater than the bond strength of the adhesive of the intermediate ply 83. The adhesive defining the upper ply 88 of the second substrate 77 has a bond strength substantially identical to the bond strength of the adhesive defining the bottom ply 82 of the first substrate 76. In addition, the adhesive defining the intermediate ply 83 of the first substrate 76 has a bond strength greater than the bond strength of the adhesive defining the lower ply 86 of the second substrate 77. This allows the second substrate 77 to delaminate from the first substrate 76 at the interface of the lower ply 86 and top ply 84 upon initial opening of the lid member 42 instead of at the interface of the intermediate ply 83 and the bottom ply 82. This delamination provides tamper evidence to a consumer upon opening of the lid member 42, since the act of delamination provides both tactile and aural feedback to the consumer to indicate whether the lid member 42 has previously been opened. Alternatively, the top ply 84 could form part of the second substrate 77 instead of the first substrate 76. In this alternative, delamination of the second substrate 77 from the first substrate 76 would occur at the interface of the top ply 84 and the intermediate ply 83 and the top ply 84 (i.e., barrier ply) would move with the lid member 42 between its opened and closed positions. In this alternative, the top ply 84 would provide some barrier protection to the product 22 in the reclosed state of the lid member 42.

As seen in FIGS. 6 and 7, once the lid member 42 is opened, the seal membrane 70 (i.e., the first substrate 76) includes an internal storage region access portion 90 and a main portion 92 (i.e., remaining portion). To facilitate removal of the access portion 90 from the main portion 92 so as to provide selective access to the internal storage region 20 and the particulate-type product 22 contained therein, the first substrate 76 of the seal membrane 70 is preferably formed to include a cut region 94 defined by a cut 95. As seen best in FIGS. 3, 5 and 7, in one preferred embodiment, the cut 95 is a continuous, straight line 97 that extends substantially perpendicular to and between the opposing face panels 12 of the canister 10. Alternatively, the cut 95 could be a curved line that extends between the opposing face panels 12 of the canister 10.

Although the cut 95 in the preferred embodiment of the seal membrane 70 takes the form of a line 97, the cut 95 can have other forms without departing from the function, spirit and scope of the present invention. For example, the cut 95 can take the form of a continuous line of a large number of small perforations. As another alternative, the cut 95 can take the form of a continuous line of a small number of large perforations. As still a further alternative, the cut 95 can take the form of a continuous line of both small and large perforations.

As seen best in FIG. 5, the first cut 95 extends at least through one of the intermediate and bottom plies 83, 82 of the first substrate 76. In one preferred embodiment, the first cut 95 extends entirely through the intermediate and bottom plies 83, 82 of the first substrate 76 (i.e., entirely through the top and bottom plies 84, 82) from the lower surface 80 of the bottom ply 82 to the upper surface of the intermediate ply 83.

By providing the seal membrane 70 with the first cut 95, separation of the access portion 90 from the main portion 92 of the first substrate 76 of the seal membrane 70 at the cut region 94 is ensured. Moreover, the functional barrier provided by the top ply 84 of the first substrate 76 of the seal membrane 70 is unaffected by the cut 95 since the cut 95 does not extend entirely through the first substrate 76 of the seal membrane 70. To allow relatively easy separation of the access portion 90 of the seal membrane 70 from the main portion 92, and to maintain the best functional barrier as provided by the seal membrane 70 it has been found that in the preferred embodiment of the present invention, as illustrated best in FIG. 5, the cut 95 should extend through the intermediate and bottom plies 83 and 82 of the first substrate 76. However, to merely permit separation of the access portion 90 of the seal membrane 70 from the main portion 92, and to merely maintain the functional barrier as provided by the seal membrane 70 it is only necessary that the cut 95 extend through at least one of the plies 82, 83.

Figure 8:
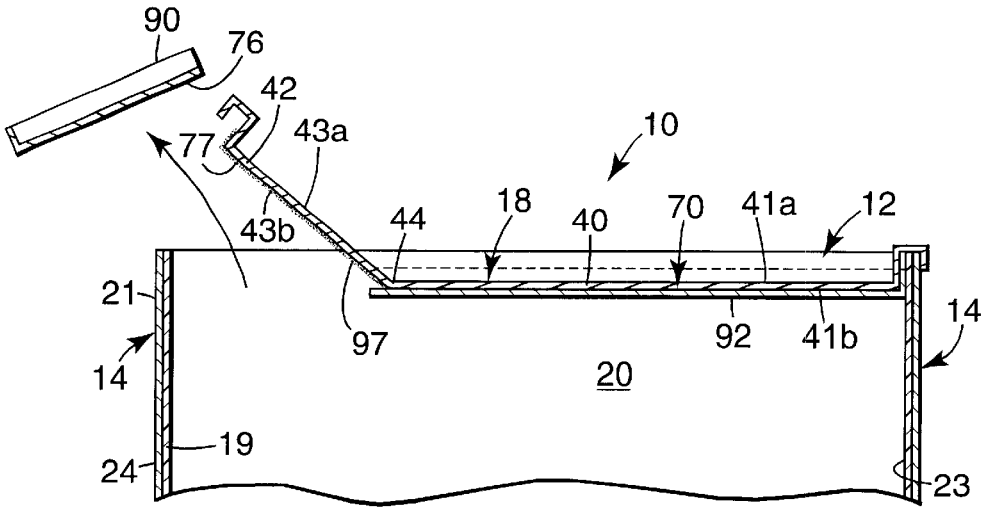
FIG. 8 is a partial sectional view similar to FIG. 6 of the canister with an internal storage region access portion of the seal membrane shown removed.
Figure 9:
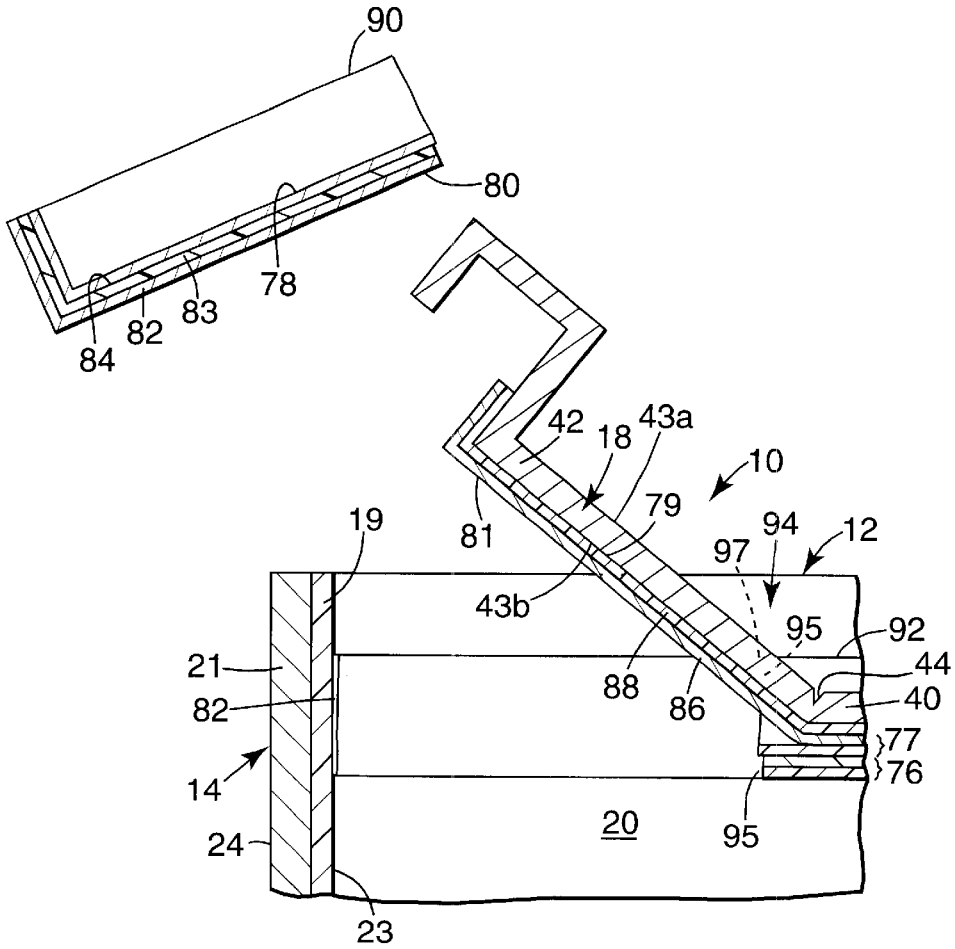
FIG. 9 is a greatly enlarged, partial sectional view similar to FIG. 8 showing details of the air tight seal membrane in accordance with the present invention.

As seen best in FIGS. 8 and 9, once the lid member 42 is opened, separation of the access portion 90 from the main portion 92 of the first substrate 76 of the seal membrane 70 occurs at the cut region 94 upon light finger pressure applied by a user directly to the cut region 94. As such, removal of the access portion 90 of the seal membrane 70 is particularly amenable to individuals with limited hand dexterity, such as a child or an elderly individual. Once separation of the access portion 90 from the main portion 92 occurs, the access portion 90 can be separated from the inner surfaces 23 of the face and side panels 12 and 14. As seen in FIGS. 8 and 9, separation of the access portion 90 from the face and side panels 12 and 14 occurs at the junction of the bottom ply 82 with the intermediate ply 83. However as seen in FIG. 9, where the bottom ply 82 is not attached to the inner surfaces 23 of the panels 12, 14, the bottom ply 82 stays attached to the intermediate ply 83 of the access portion 90.

The cut 95 can be imparted to the seal membrane 70 via any readily available manufacturing technique, such as die cutting, and can assume a wide variety of forms. In addition, the line 97 defined by the cut 95 can assume a wide variety of forms. For example, the line 97 can assume a curved form, a single saw tooth shape (i.e. V-shaped) or a series of saw teeth appearance. Additionally, the seal membrane 70 can include indicia 74 (FIG. 3) configured to provide visual instructions to a user for removal of the access portion 90 of the seal membrane 70. For example, the indicia 74 can include words, symbols or illustrations describing to a user the necessary steps for removal of the access portion 90 from the canister 10.

Figure 10:
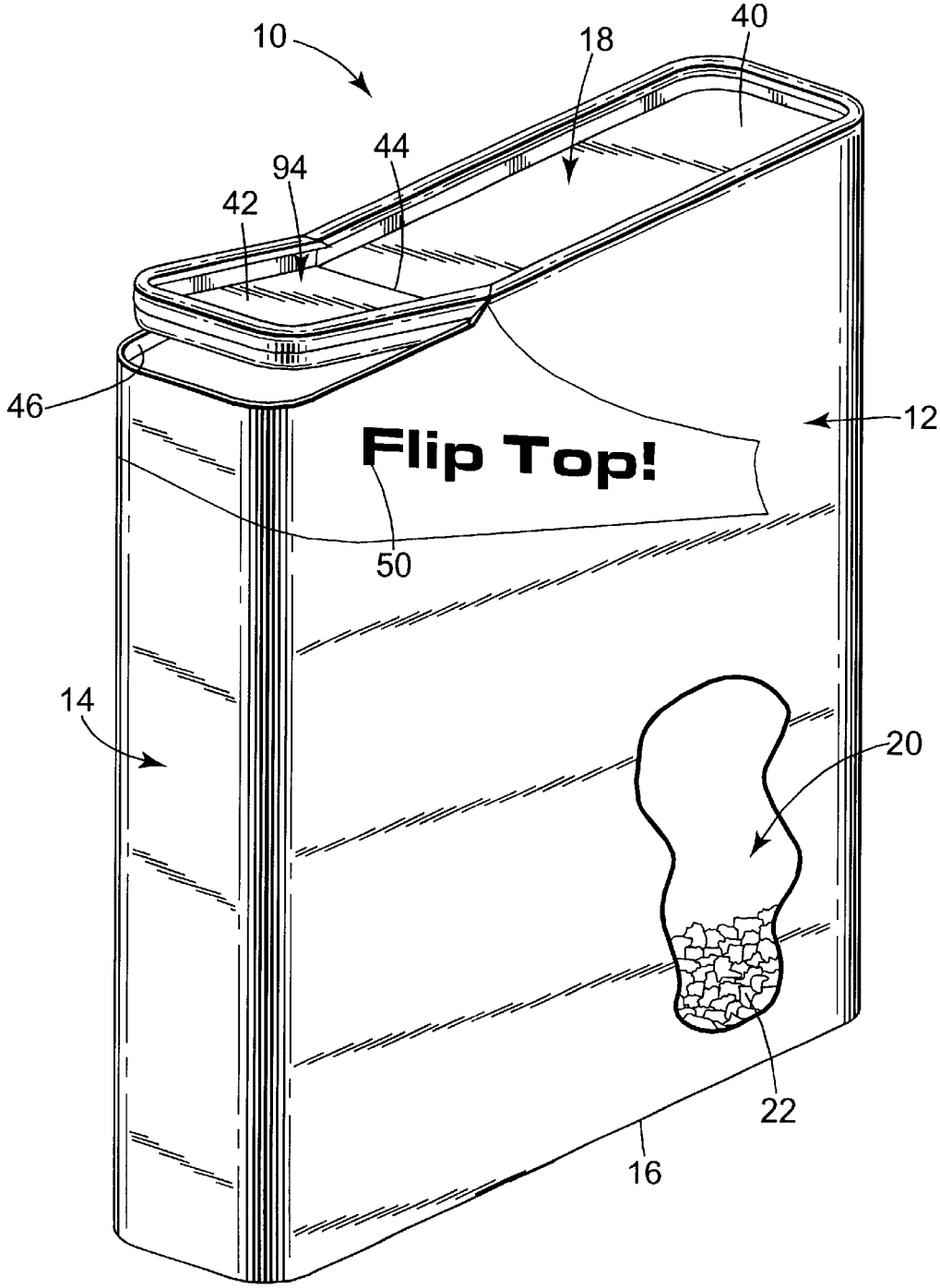
FIG. 10 is a perspective view of the canister in accordance with the present invention further illustrating the movable lid portion.

By preferably providing the movable lid 42, access to the internal storage region 20, and thus the particulate-type product 22, is easily gained once the access portion 90 of the seal membrane 70 is removed. With respect to FIG. 10, movement of the lid 42 to an open position and the removal of the access portion 90 of the seal membrane 70 generates a pour opening 46 in the top panel 18. Due to the relatively rigid nature of the top panel 18 and the main portion 92 (i.e., remaining portion) of seal membrane 70, the pour opening 46 is fixed in terms of shape and size. The pour opening 46 is preferably configured to be relatively large. For example, the pour opening 46 preferably has a width approximating a spacing between the opposing face panels 12 and length of at least one fourth a length of the top panel 18, more preferably one-third. Alternatively, other sizes can also be useful. For example, the size of the pour opening 46 can be designed specifically to the particular product contained within the canister 10 to provide controlled pouring of that product. By providing a fixed, relatively large configuration for the pour opening 46, regulated, consistent flow of product through the pour opening 46 can be achieved as described below. In other words, the fixed pour opening 46 will not change in shape or size, unlike the standard box with an inner liner package.

Figure 11:
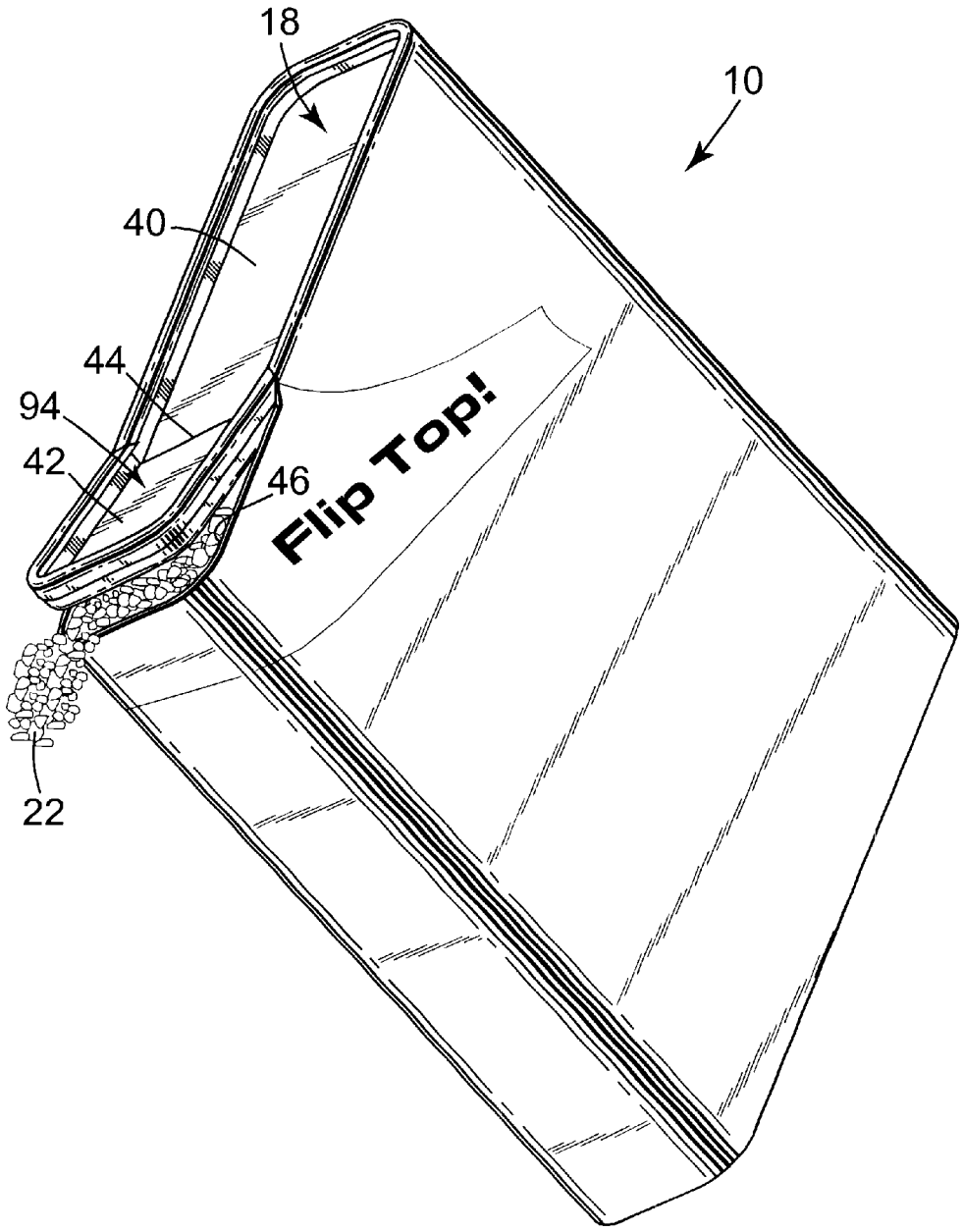
FIG. 11 illustrates a canister in accordance with the present invention in a pouring operation.

Movement of the lid 42 to an open position is best shown with reference to FIG. 11. In one preferred embodiment, the top panel 18 is configured such that the lid 42 is independently maintained in the open position such as by friction or other mechanical means. In other words, a user (not shown) must purposely move the lid 42 back to the closed position (FIG. 1); the lid 42 will not unexpectedly "close" on its own. As further shown in FIG. 11, the canister 10 preferably includes indicia 50 providing visual guidance and/or instructions relating to proper operation of the movable lid 42. The indicia 50 can be formed on any of the panels 12–18, and can extend or be continuous from one panel, such as one of the opposing face panels 12, to another panel, such as one of the opposing side panels 14. The indicia 50 may assume a wide variety of forms, including words, symbols, illustrations, etc. In addition to providing instructions on operation of the movable lid 42, the indicia 50 can also be configured to draw a consumer's (not shown) attention to the movable lid feature, thereby potentially enticing a consumer to purchase the canister 10 and the product 22 disposed therein.

Figure 12A:
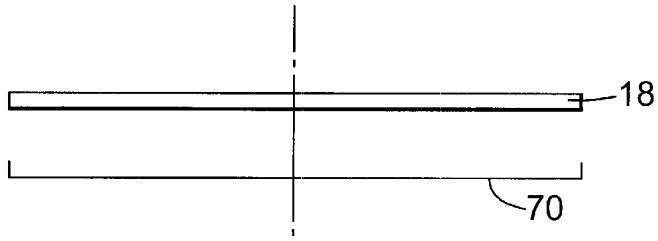
FIG. 12A is an exploded view illustrating the air tight seal membrane being attached to a top panel of a canister in accordance with a method of manufacture of the present invention.
Figure 12B:
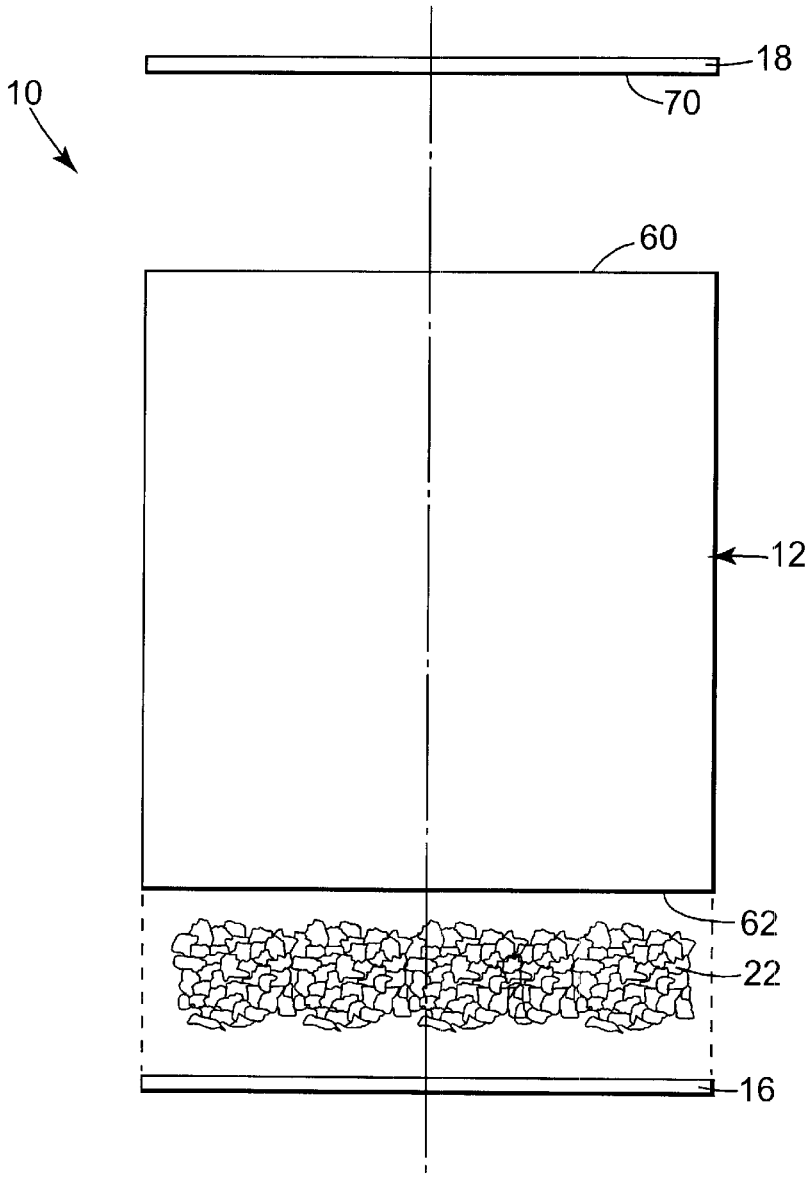
FIG. 12B is an exploded view further illustrating the method of manufacturing the canister in accordance with the present invention.

A preferable embodiment of assembly of the canister 10 is shown generally in FIGS. 12A and 12B. First, as seen in FIG. 12A, the seal membrane 70 is secured to the lower surfaces 41*b*, 43*b* of the body portion 40 and the lid member 42 by way of the adhesive defining the upper ply 88 of the second substrate 77. As previously described, the opposing face panels 12 and the opposing side panels 14 are preferably integrally formed. In this regard, a combination of the opposing face panels 12 and the opposing side panels 14 defines the upper opening 60 and the lower opening 62. Next, the top panel 18/seal membrane 70 combination is affixed to the inner surfaces 23 of the opposing face and side panels 12 and 14 via the adhesive defining the bottom ply 82 of the first substrate 76. In one preferred embodiment, the top panel 18/seal membrane 70 is adhesively attached directly to the plastic layer 19 of the panels 12, 14. The top panel 18/seal membrane 70 encompass the upper opening 60. Once assembled, the opposing face panels 12, the opposing side panels 14 and the top panel 18 combine to define the internal storage region 20 (FIG. 1). A desired volume of the particulate-type product 22 is then disposed within the internal storage region 20. Finally, the bottom panel 16 is connected to the opposing face panels 12 and the opposing side panels 14 so as to encompass the lower opening 62. In one preferred embodiment, the bottom panel 16 is directly sealed to the panels 12, 14. Alternatively, a separate attachment body, such as an adhesive tape or laminant, or other mechanical device, can be used to affix the bottom panel 16. Upon final assembly, the particulate-type product 22 is sealed within the internal storage region 20.

During use, the lid 42 is maneuvered from the closed position (FIG. 1) to the open position (FIGS. 6 and 7). For example, the lid 42 can be pivoted relative to the body portion 40 which causes the second substrate 77 to delaminate from the first substrate 76 only at the lid member area. Next, the access portion 90 is separated from the main portion 92 of the seal membrane 70 along the cut 95 using finger pressure (FIGS. 8 and 9). The access portion 90 is then grasped and separated (i.e., peeled) from the inner surfaces 23 of the face and side panels 12, 14 at the junction of the bottom ply 82 and the intermediate ply 83. Following opening of the lid 42 and removal of the access portion 90 of the seal membrane 70, a user (not shown) is then able to pour a desired quantity of the particulate-type product 22 as shown in FIG. 11. During this pouring operation, the user is able to directly confirm product flow rate and volume. In other words, unlike a "standard" box with an inner liner design, the canister 10 of the present invention does not impede the user's view of the opening 46. In the open position, the canister 10 does not include any upwardly extending flaps or similar carton material that would otherwise obstruct viewing of the opening 46 and thus flow of the product 22 from the canister 10. Further, as previously described, the opening 46 is preferably fixed. Thus, a relatively consistent product flow and volume from the canister 10 can be achieved from use-to-use. Along these same lines, because the canister 10 does not require a separate liner or inner bag, the long standing problem of liner dislodgment during pouring will not occur. In short, the regulated product flow prevents an unexpectedly large volume of product from being distributed from the canister 10, and thereby minimizes spillage. As a point of reference with respect to FIG. 11, the lid 42 can be positioned or pivoted at a greater angle relative to the body portion 40 for pouring larger sized product particles.

Following distribution of a desired volume of the product 22 from the canister 10, the lid 42 is returned to the closed position (FIG. 1). Once again, the user is not required to fold or roll a separate inner liner or bag to effectuate closure. As previously described, the lid 42 is preferably frictionally secured in the closed position. Thus, following use and reclosure, the canister 10 provides a relatively complete functional barrier to at least one of flavor, aroma, moisture, oil, grease, contaminants, insects, etc., thereby giving a perceived increase in product freshness. Additionally, by selectively securing the lid 42 in the closed position, the canister 10 can be placed in any orientation, whether purposefully or accidentally, without undesired spillage of the product 22 from the canister 10. In other words, during normal storage, the canister 10 is typically placed upright, supported by the bottom panel 16. Alternatively, however, the canister 10 can be stored in a prone position whereby the canister is supported at one of the face panels 12, the opposing side panels 14 or the top panel 18. With any of these orientations, the lid 42 remains in the closed position, thereby preventing accidental release of the product 22. Similarly, in the event the canister 10 is inadvertently tipped from the upright position, the lid 42 will remain in the closed position, again preventing accidental product spillage.

The canister of the present invention provides a marked improvement over previous designs. Pointedly, the canister eliminates the need for, and associated problems found with, a separate plastic liner or bag required by currently used box with an inner liner packaging. Persons with limited hand dexterity are no longer required to use a hand tool, such as a knife or scissors, to open the packaging. At the same time, by utilizing the air-tight seal membrane and a combination paper and plastic material for the various panels comprising the canister, product integrity is maintained. Further, preferred features of the canister directly address consumer preferences. For example, incorporating a movable lid and easily removable sealing membrane access portion, the canister easy to open and reclose. Similarly, the movable lid and the remaining portion of the seal membrane preferably generates a fixed opening, thereby providing for consistent, regulated product flow. Additionally, the seal membrane, lid and canister of the present invention can conveniently be handled by individuals with limited hand dexterity. Lastly, securing the seal membrane to the lower surface of the top closure and lid member prior to attaching the top closure/seal membrane to the upper opening of the tubular main body portion of the canister, allows this upper opening to be consistently, readily and easily sealed thereby forming an air tight seal at this upper opening capable of maintaining the freshness and the integrity of the particulate-type product, by preventing such things as contaminants, flavor aroma, moisture, oil, grease, small insects, etc. from passing through to the contained product.

Although the present invention has been described with reference to preferred embodiments, workers skilled in the art will recognize that changes may be made in form and detail without departing from the spirit and scope of the present invention. For example, the canister has been depicted as being generally rectangular in shape. Alternatively, other shapes are equally acceptable. Also, the canister can contain items in addition to the particulate-type product. For example, a coupon or premium can be placed within the canister along with the particulate-type product.

What is claimed is:

1. A canister for storing a particulate product, the canister comprising:

a main body portion having an inner surface and an outer surface, the main body portion defining an upper opening and a lower opening;

a bottom closure connected to the main body portion so as to encompass the lower opening, wherein the main body portion and the bottom closure combine to define an internal storage region;

a top closure having an upper surface and a lower surface, the top closure being connected to the main body portion so as to encompass the upper opening, and the top closure including an openable lid member having an upper surface and a lower surface, the lid member providing selective access to the internal storage region;

a seal membrane forming a seal at the upper opening configured to maintain integrity of particulate product disposed within the internal storage region, the seal membrane including:

a first substrate having a first surface and a second surface, the second surface of the first substrate being secured to the inner surface of the main body portion and positioned immediately adjacent particulate product disposed within the internal storage region; and a second substrate having a first surface and a second surface, the first surface of the second substrate being non-removably secured to at least a portion of the lower surface of the lid member, and the second surface of the second substrate being removably secured to the first surface of the first substrate, such that upon initial opening of the lid member, the second substrate delaminates from the first substrate at an interface, defined between the second surface of the second substrate and the first surface of the first substrate, and remains affixed to the lower surface of the lid member.

2. The canister of claim 1 wherein the main body portion of the canister includes:

opposing face panels, each of the opposing face panels having an inner surface and an outer surface; and opposing side panels, each of the opposing side panels having an inner surface and an outer surface, wherein the opposing face and side panels define the upper and lower openings, wherein the opposing face and side panels and the bottom closure combine to define the internal storage region, wherein the top and bottom closures are connected to the opposing face panels, and wherein the seal membrane is connected to the inner surfaces of the opposing face and side panels.

3. The canister of claim 2 wherein the second substrate includes:

an upper ply having an upper surface, defining the first surface of the second substrate, and a lower surface, the upper ply non-removably securing the second substrate to the at least a portion of the lower surface of the lid member; and a lower ply having an upper surface, and a lower surface defining the second surface of the second substrate, the lower ply removably securing the second substrate to the first surface of the first substrate.

4. The canister of claim 3 wherein the upper ply is a first adhesive, and the lower ply is a second adhesive different from the first adhesive.

5. The canister of claim 4 wherein the first adhesive has a first bond strength, and wherein the second adhesive has a second bond strength that is less than the first adhesive.

6. The canister of claim 3 wherein the upper ply non-removably secures the second substrate to substantially all of the lower surface of the lid member.

7. The canister of claim 6 wherein the upper ply non-removably secures the second substrate to at least a portion of the lower surface of the top closure.

8. The canister of claim 7 wherein the upper ply non-removably secures the second substrate to substantially all of the lower surface of the top closure.

9. The canister of claim 2 wherein the second substrate is non-removably secured to substantially all of the lower surface of the lid member.

10. The canister of claim 9 wherein the second substrate is non-removably secured to at least a portion of the lower surface of the top closure.

11. The canister of claim 10 wherein the second substrate is non-removably secured to substantially all of the lower surface of the top closure.

12. The canister of claim 5 wherein the first substrate includes:

a top ply having an upper surface, defining the first surface of the first substrate, and a lower surface;

an intermediate ply having an upper surface secured to the lower surface of the top ply, and a lower surface; and a bottom ply having an upper surface secured to the lower surface of the intermediate ply, and a lower surface defining the second surface of the first substrate.

13. The canister of claim 12 wherein at least one of the first and second substrates includes a barrier ply that forms the seal at the upper opening for maintaining integrity of particulate product disposed within the internal storage region.

14. The canister of claim 13 wherein the first substrate includes the barrier ply.

15. The canister of claim 14 wherein the top ply of the first substrate is the barrier ply that forms the seal at the upper opening for maintaining integrity of particulate product disposed within the internal storage region.

16. The canister of claim 12 wherein the bottom ply is substantially non-removably secured to the inner surface of the main body portion where the bottom ply engages the inner surface of the main body portion, and wherein the intermediate ply is removably secured to the bottom ply.

17. The canister of claim 16 wherein the intermediate ply is a third adhesive, and the bottom ply is a fourth adhesive different from the third adhesive.

18. The canister of claim 17 wherein the third adhesive has a third bond strength, and wherein the fourth adhesive has a fourth bond strength that is greater than the third adhesive.

19. The canister of claim 18 wherein the first bond strength of the first adhesive is substantially identical to the fourth bond strength of the fourth adhesive.

20. The canister of claim 19 wherein the third bond strength of the third adhesive is greater than the second bond strength of the second adhesive.

21. The canister of claim 16 wherein the first substrate defines a cut that extends through at least one of the intermediate and bottom plies to configure the first substrate of the seal membrane for selective access to the internal storage region and thereby particulate product.

22. The canister of claim 21 wherein the cut extends entirely through both of the intermediate and bottom plies from the lower surface of the bottom ply to the upper surface of the intermediate ply.

23. The canister of claim 22 wherein the cut facilitates selective removal of at least a portion of the first substrate of the seal membrane from the upper opening to provide the selective access to the internal storage region and particulate product therein.

24. The canister of claim 23 wherein the cut facilitates removal of only an internal storage region access portion of the first substrate of the seal membrane from the upper opening.

25. The canister of claim 24 wherein the cut forms a line.

26. The canister of claim 25 wherein the line is straight.

27. The canister of claim 26 wherein the line extends substantially perpendicular to and between the opposing face panels, and wherein the first line is closely spaced from the second line in a direction substantially parallel to the opposing face panels.

28. The canister of claim 27 wherein the line is a continuous line of perforations.

29. The canister of claim 24 wherein the cut facilitates removal of only the internal storage region access portion of the first substrate of the seal membrane, and wherein upon removal of the access portion from a remaining portion of the seal membrane, the access portion separates from the remaining portion of the seal membrane at the cut and the access portion separates from the inner surfaces of the panels at a junction of the lower surface of the bottom ply and the inner surfaces of the panels.

30. The canister of claim 1 wherein the canister is configured to store a dry particulate product.

31. The canister of claim 1 wherein the canister is configured to store a particulate food product.

32. The canister of claim 1 wherein the canister is configured to store a particulate cereal food product.

33. The canister of claim 1 wherein the canister is configured to store a particulate ready-to-eat cereal food product.

34. The canister of claim 24 wherein the internal storage region access portion of the first substrate of the seal membrane includes indicia.

35. The canister of claim 1 wherein seal membrane functions to provide tamper evidence to a consumer.

36. A packaged good article comprising:

a canister including:

a main body portion having an inner surface and an outer surface, the main body portion defining an upper opening and a lower opening;

a bottom closure connected to the main body portion so as to encompass the lower opening, wherein the main body portion and the bottom panel combine to define an internal storage region;

a top closure having an upper surface and a lower surface, the top closure being connected to the main body portion so as to encompass the upper opening, and the top closure including an openable lid member having an upper surface and a lower surface, the lid member providing selective access to the internal storage region;

a seal membrane forming a seal at the upper opening configured to maintain integrity of particulate product disposed within the internal storage region, the seal membrane including:

a first substrate having a first surface and a second surface, the second surface of the first substrate being secured to the inner surface of the main body portion and positioned immediately adjacent particulate product disposed within the internal storage region; and a second substrate having a first surface and a second surface, the first surface of the second substrate being non-removably secured to at least a portion of the lower surface of the lid member, and the second surface of the second substrate being removably secured to the first surface of the first substrate, such that upon initial opening of the lid member, the second substrate delaminates from the first substrate at an interface, defined between the second surface of the second substrate and the first surface of the first substrate, and remains affixed to the lower surface of the lid member; and a particulate product disposed within the internal storage region, the seal membrane being configured to maintain integrity of the particulate product disposed within the internal storage region.

37. The packaged good article of claim 36 wherein the main body portion of the canister includes:

opposing face panels, each of the opposing face panels having an inner surface and an outer surface; and opposing side panels, each of the opposing side panels having an inner surface and an outer surface, wherein the opposing face and side panels define the upper and lower openings, wherein the opposing face and side panels and the bottom closure combine to define the internal storage region, wherein the top and bottom closures are connected to the opposing face panels, and wherein the seal membrane is connected to the inner surfaces of the opposing face and side panels.

38. The packaged good article of claim 37 wherein the second substrate includes:

an upper ply having an upper surface, defining the first surface of the second substrate, and a lower surface, the upper ply non-removably securing the second substrate to the at least a portion of the lower surface of the lid member; and a lower ply having an upper surface, and a lower surface defining the second surface of the second substrate, the lower ply removably securing the second substrate to the first surface of the first substrate.

39. The packaged good article of claim 38 wherein the upper ply is a first adhesive, and the lower ply is a second adhesive different from the first adhesive.

40. The packaged good article of claim 39 wherein the first adhesive has a first bond strength, and wherein the second adhesive has a second bond strength that is less than the first adhesive.

41. The packaged good article of claim 38 wherein the upper ply non-removably secures the second substrate to substantially all of the lower surface of the lid member.

42. The packaged good article of claim 41 wherein the upper ply non-removably secures the second substrate to at least a portion of the lower surface of the top closure.

43. The packaged good article of claim 42 wherein the upper ply non-removably secures the second substrate to substantially all of the lower surface of the top closure.

44. The packaged good article of claim 40 wherein the first substrate includes:

a top ply having an upper surface, defining the first surface of the first substrate, and a lower surface;

an intermediate ply having an upper surface secured to the lower surface of the top ply, and a lower surface; and a bottom ply having an upper surface secured to the lower surface of the intermediate ply, and a lower surface defining the second surface of the first substrate.

45. The packaged good article of claim 44 wherein the top ply is a barrier ply that forms the seal at the upper opening for maintaining integrity of the particulate product disposed within the internal storage region.

46. The packaged good article of claim 44 wherein the bottom ply is non-removably secured to the inner surface of the main body portion, and wherein the intermediate ply is removably secured to the bottom ply.

47. The packaged good article of claim 46 wherein the intermediate ply is a third adhesive, and the bottom ply is a fourth adhesive different from the third adhesive.

48. The packaged good article of claim 47 wherein the third adhesive has a third bond strength, and wherein the fourth adhesive has a fourth bond strength that is greater than the third adhesive.

49. The packaged good article of claim 48 wherein the first bond strength of the first adhesive is substantially identical to the fourth bond strength of the fourth adhesive.

50. The packaged good article of claim 49 wherein the third bond strength of the third adhesive is greater than the second bond strength of the second adhesive.

51. The packaged good article of claim 50 wherein the first substrate defines a cut that extends through at least one of the intermediate and bottom plies to configure the first substrate of the seal membrane for selective access to the internal storage region and thereby the particulate product.

52. The packaged good article of claim 51 wherein the cut extends entirely through both of the intermediate and bottom plies from the lower surface of the bottom ply to the upper surface of the intermediate ply.

53. The packaged good article of claim 52 wherein the cut facilitates selective removal of at least a portion of the first substrate of the seal membrane from the upper opening to provide the selective access to the internal storage region and the particulate product therein.

54. The packaged good article of claim 53 wherein the cut facilitates removal of only an internal storage region access portion of the first substrate of the seal membrane from the upper opening.

55. The packaged good article of claim 54 wherein the cut forms a line.

56. The packaged good article of claim 55 wherein the line is straight.

57. The packaged good article of claim 56 wherein the line extends substantially perpendicular to and between the opposing face panels, and wherein the first line is closely spaced from the second line in a direction substantially parallel to the opposing face panels.

58. The packaged good article of claim 57 wherein the line is a continuous line of perforations.

59. The packaged good article of claim 54 wherein the cut facilitates removal of only the internal storage region access portion of the first substrate of the seal membrane, and wherein upon removal of the access portion from a remaining portion of the seal membrane, the access portion separates from the remaining portion of the seal membrane at the cut and the access portion separates from the inner surfaces of the panels at a junction of the lower surface of the bottom ply and the inner surfaces of the panels.

60. The packaged good article of claim 36 wherein the particulate product is dry.

61. The package good article of claim 36 wherein the particulate product is a food product.

62. The packaged good article of claim 61 wherein the food product is cereal.

63. The packaged good article of claim 61 wherein the food product is ready-to-eat cereal.

64. The packaged good article of claim 54 wherein the internal storage region access portion of the first substrate of the seal membrane includes indicia.

65. The packaged good article of claim 59 wherein the lid member is configured to be movable from a closed position in which the lid is substantially contiguous with the body portion to prevent displacement of product from the internal storage region and an open position in which the second substrate is moved with the lid member and at least a portion of the lid is spaced from the body portion to allow passage of the particulate product from the internal storage region through a pour opening defined by a spacing of the lid member from the body portion and absence of the access portion of the seal membrane.

* * * * *